US006932220B2

(12) United States Patent
Byun

(10) Patent No.: US 6,932,220 B2
(45) Date of Patent: Aug. 23, 2005

(54) COSMETIC CASE

(76) Inventor: Young Kwang Byun, MokdongSinsigaji Apt. 928-1005, 312, Shinjung-dong, Yangchun-gu, Seoul (KR)

( * ) Notice: Subject to any disclaimer, the term of this patent is extended or adjusted under 35 U.S.C. 154(b) by 190 days.

(21) Appl. No.: 10/640,836

(22) Filed: Aug. 14, 2003

(65) Prior Publication Data

US 2005/0011806 A1 Jan. 20, 2005

(30) Foreign Application Priority Data

Mar. 26, 2003 (KR) ..... 10-2003-0018695

(51) Int. Cl.[7] ..... B65D 71/00

(52) U.S. Cl. ..... 206/581; 132/287; 132/294; 132/295; 132/314; 132/315

(58) Field of Search ..... 132/293, 294, 132/295, 287, 305, 313, 314, 315; 206/372, 373, 581, 823

(56) References Cited

U.S. PATENT DOCUMENTS 1,519,021 A * 12/1924 De Bernardi ..... 132/297
3,502,089 A * 3/1970 Lucien Paradis ..... 132/294
4,807,773 A * 2/1989 Tsai ..... 220/4.27
4,898,195 A * 2/1990 Sussman ..... 132/317
5,163,457 A * 11/1992 Lombardi, Jr. ..... 132/304
5,638,838 A * 6/1997 Lombardi ..... 132/294
6,302,120 B1 * 10/2001 Kuo ..... 132/295
6,378,533 B1 * 4/2002 Roman ..... 132/295
2004/0129599 A1 * 7/2004 Yi-Hung ..... 206/581

* cited by examiner

*Primary Examiner*—David T. Fidei
(74) *Attorney, Agent, or Firm*—Bell, Boyd & Lloyd LLC

(57) ABSTRACT

A cosmetic case is disclosed. The cosmetic case includes: a main case (1) having a foundation receiving space (3), a chamber located on the lower portion of the receiving space (3), an opening path (5) formed in a side of the chamber, a protrusion (6) formed on the rear portion and having a shaft hole (7) for hinge coupling, and a guide groove (10) formed in the front surface; a cover (20) having a lid (21) for the receiving space (3) of the main case (1), coupling plates (22) hinged to the protrusion (6) of the main case (1), and a locking panel (23) having a locking jaw (25) corresponding to the guide groove (10); a receiving drawer (30) hinged to the chamber of the main case (1) and having a locking groove (38) matching with the locking panel (23); and a spring (40) for providing elasticity so that the receiving drawer (30) is rotated and exposed out of the opening path(5). When a user opens the cover (20), the receiving drawer (30) seated on the lower portion is opened, and then, the user can easily use cosmetics and make-up tools.

6 Claims, 6 Drawing Sheets

COSMETIC CASE

BACKGROUND OF THE INVENTION

1. Field of the Invention

The present invention relates to a cosmetic case, and more particularly, to a cosmetic case capable of receiving color tone cosmetics and brushes of various kinds, which are used for applying make-up to cheeks and around eyes, in a case and capable of being easy in carrying along with it and safekeeping owing to its small volume.

2. Background of the Related Art

In general, a cosmetic case includes a case body, a cover pivotally connected to the case body and opened and closed through rotation, and a space for receiving cosmetics inside. Women, who have professional careers, such as models, performers and the likes, have to repeatedly do a series of actions for applying and removing make-up of various kinds or to change colors of the make-up according to environments or atmosphere, and so they have to carry along cosmetics of various kinds. However, the conventional cosmetic cases are too heavy as they have large volume and a small cosmetics receiving space.

SUMMARY OF THE INVENTION

Accordingly, the present invention is directed to a cosmetic case that substantially obviates one or more problems due to limitations and disadvantages of the related art.

An object of the present invention is to provide a cosmetic case, which has a compact receiving space by forming a double cosmetic receiving space, and which is easy in use and carrying as it exposes a lower receiving drawer when a user opens the cosmetic case.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the cosmetic case includes: a main case having a cosmetic receiving space made of a round plate for storing foundation, a chamber located on the lower portion of the receiving space and having a plate surrounding all directions of the receiving space and an upper plate and a lower plate, an opening path formed in a side of the chamber, a protrusion formed on the rear portion of the main case and having a shaft hole for hinge coupling, and a guide groove formed in the front surface of the main case; a cover having a lid for inserting the round plate constituting the receiving space of the main case, coupling plates coupled to the cover, each of the coupling plate having a shaft hole to be hinged to the protrusion of the main case, and a locking panel having a locking jaw corresponding to the guide groove; a receiving drawer having a pin for hinging the upper plate and the lower plate of the chamber of the main case, and a locking groove matching with the locking panel and having a locking protrusion for fixing the locking jaw; and a spring having an end fixed to the main case, the other end fixed to a hole formed in the receiving drawer, and a coiled portion for inserting a pin of the receiving drawer.

In another aspect of the present invention, the cosmetic case includes: a main case made of an integrated plate surrounding all direction and constructed in such that the lower portion is closed and the upper portion is opened, the main case having an opening path formed in one side thereof, a horizontally straight slot formed in the front surface of the inside thereof, a locking groove formed in the front surface of the main case and connected with the straight slot, a coupling groove formed in the center of the rear surface of the inside of the main case and recessed inwardly, shaft holes formed in both sides of the side portion, a seating step formed on the top surface of the plate surrounding all directions of the main case, and protrusions formed on both side surfaces of the opening path; a make-up case having a flange matching with the shape of the seating step of the main case, and a partition formed integrally with the flange for allowing receipt of different cosmetics; a cover having a coupling plate matching with the coupling groove of the main case and having shaft holes corresponding and hinged with the shaft holes of the main case and a concave portion formed on the center and having inclined surface on both sides, a cover plate being at a right angle to the coupling plate and having the protruding circumference, and a locking panel having a locking jaw coupled with the locking groove of the main case and a locking step being at a right angle to the locking jaw; a receiving drawer of a rectangular drawer type, the receiving drawer having the partition for making a receiving space to receive make-up tools, a stop step inserted and sliding into the straight slot of the main case and locked to the locking step of the locking panel, a slider mounted on the outer side surface and having the lower surface caught to the locking jaw, and protrusions formed on both sides; a hinge shaft inserted into the shaft hole formed in the side surface of the main case and the shaft hole formed in the both sides of the coupling plate of the cover for hinging the cover to the main case; and a coil spring mounted on the main case for providing elasticity so that the receiving drawer is bounced out of the main case.

It is preferable that the receiving drawer has the partition and a receiving cover hinged to the top of the side plate for opening and closing a part of the receiving space.

It is preferable that the partition and the side plate constituting the receiving space respectively have pickup groove for allowing a user to easily pick up toilet tools, and the receiving space has a semicircle groove for seating a round article, such as a grip of a make-up brush.

It is preferable that the cover has a mirror.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

A cosmetic case according to the present invention includes a main case 1, a receiving drawer 30, a cover 20, and a spring 40.

Figure 1:
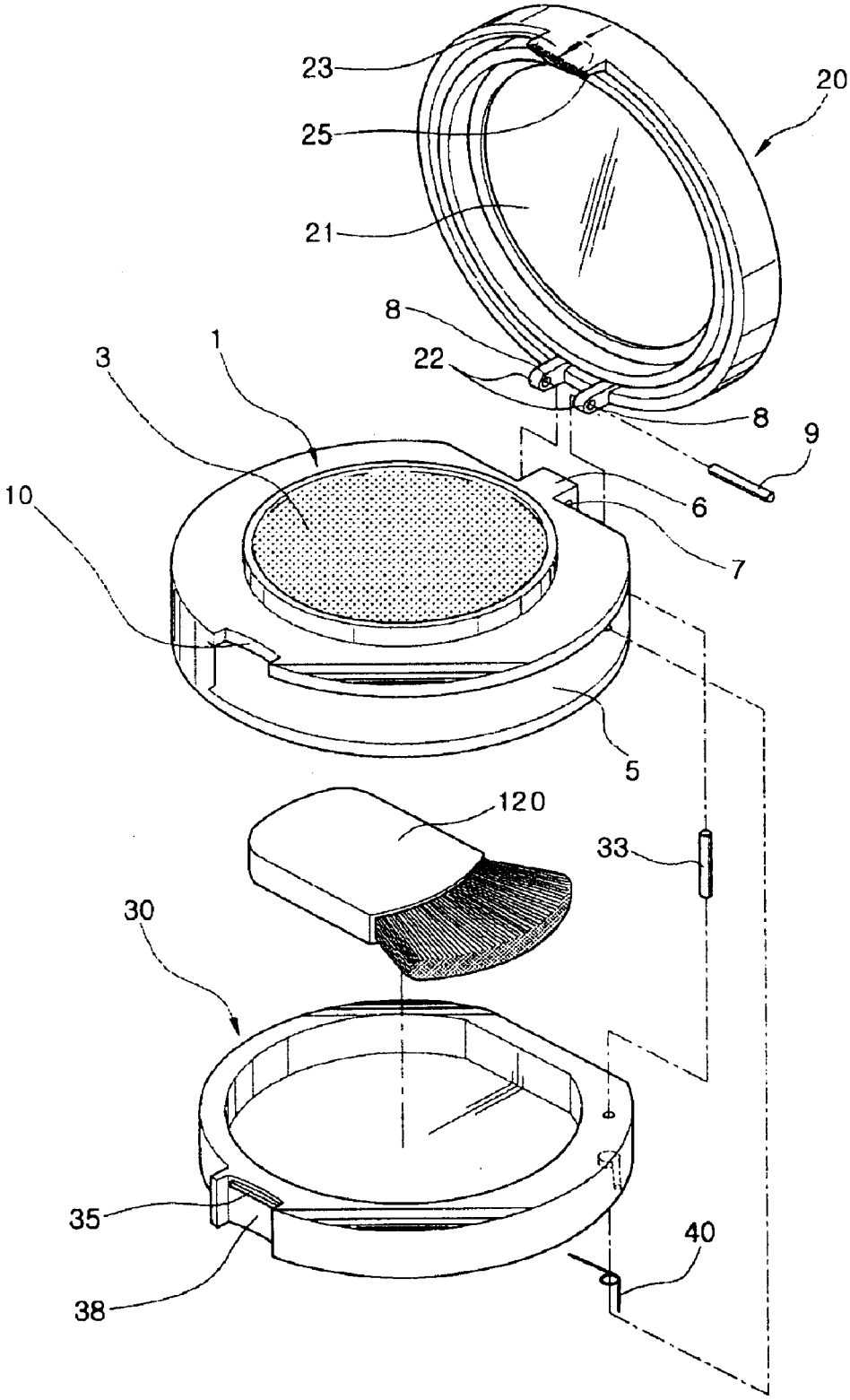
FIG. 1 is an exploded perspective view of a cosmetic case according to a first preferred embodiment of the present invention.
Figure 2:
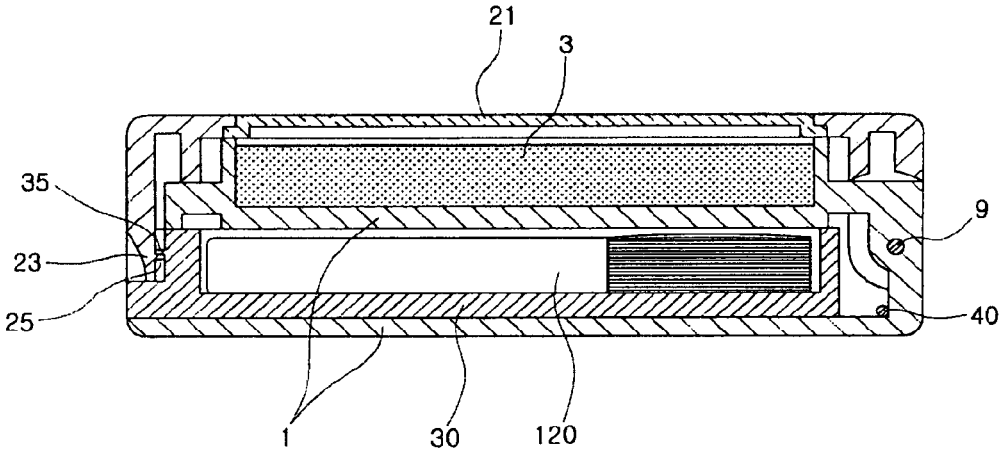
FIG. 2 is a sectional view of the cosmetic case according to the first preferred embodiment.

As shown in FIG. 1, the main case 1 includes a cosmetic receiving space 3 made of a round plate for storing foundation, a chamber located on the lower portion of the receiving space and having a plate surrounding all directions of the receiving space 3 and an upper plate and a lower plate, an opening path 5 formed in a side of the chamber, a protrusion 6 formed on the rear portion of the main case 3 and having a shaft hole 7 for hinge coupling, and a guide groove 10 formed in the front surface of the main case 3.

The cover 20 includes a lid 21 for inserting the round plate constituting the receiving space 3 of the main case 1, coupling plates 22 coupled to the cover 20 and respectively having shaft holes 7 to be hinged to the protrusion 6 of the main case 1, and a locking panel 23 having a locking jaw 25 corresponding to the guide groove 10.

The receiving drawer 30 includes a pin 33 for hinging the upper plate and the lower plate of the chamber of the main case 1, and a locking groove 38 matching with the locking panel 23 and having a locking protrusion 35 for fixing the locking jaw 25.

Figure 3:
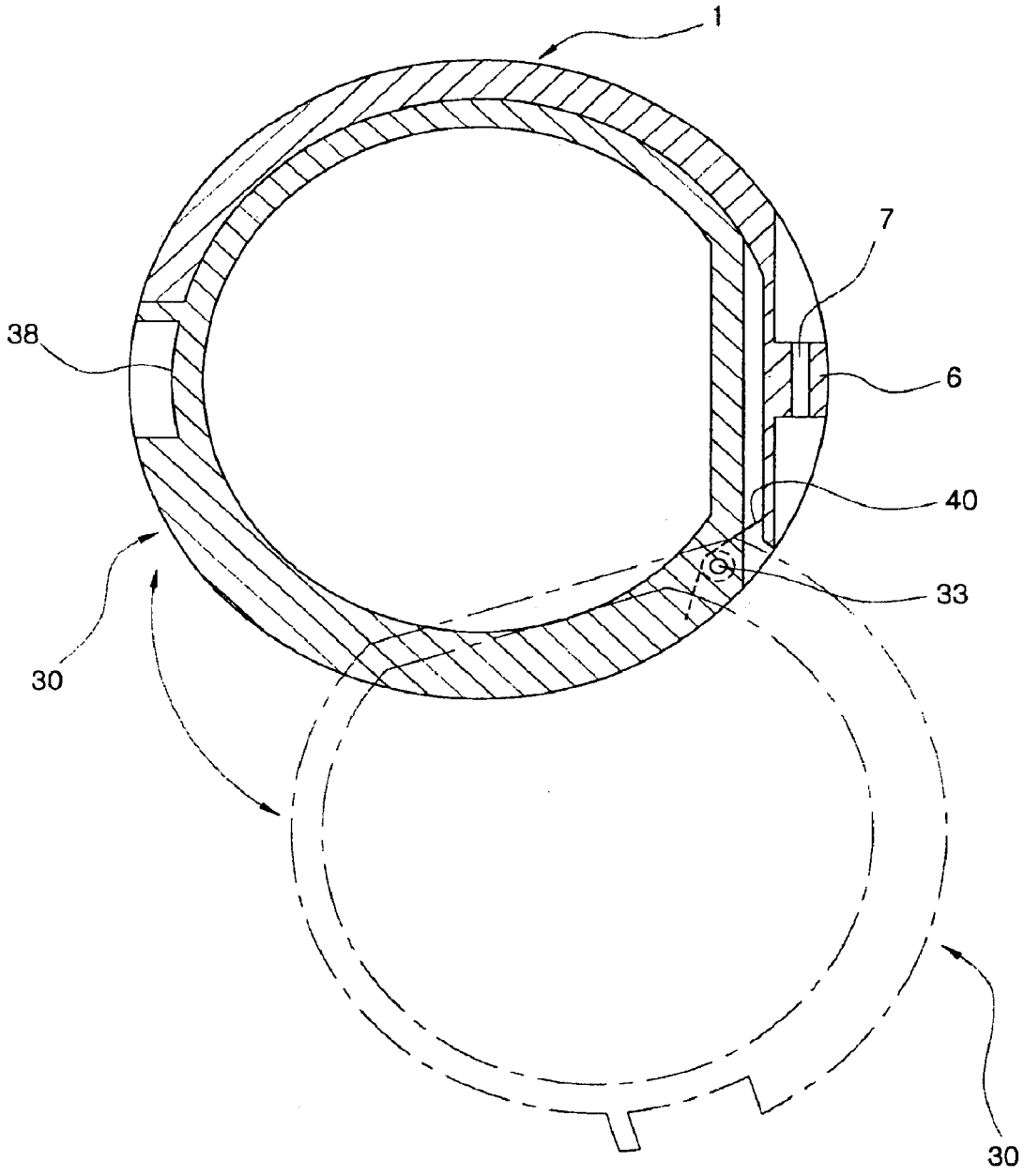
FIG. 3 is a horizontally sectional view showing a state in which a receiving drawer of the cosmetic case of the present invention is opened.

The spring 40 includes an end fixed to the main case 1, the other end fixed to a hole formed in the receiving drawer 30, and a coiled portion for inserting a pin 33 of the receiving drawer 30. As shown in FIG. 3, when the cover 20 is rotated and opened, the spring 40 provides elasticity so that the locking panel 23 of the cover 20 is separated from the locking groove 38 of the receiving drawer 30 so as to rotate and expose the receiving drawer 30 to the outside of the opening path 5.

In a second preferred embodiment of the present invention, the cosmetic case includes a main case 60, a make-up case 80, a cover 87, a receiving drawer 110, a mirror, a coil spring 111, and a locking panel 95.

Figure 4:
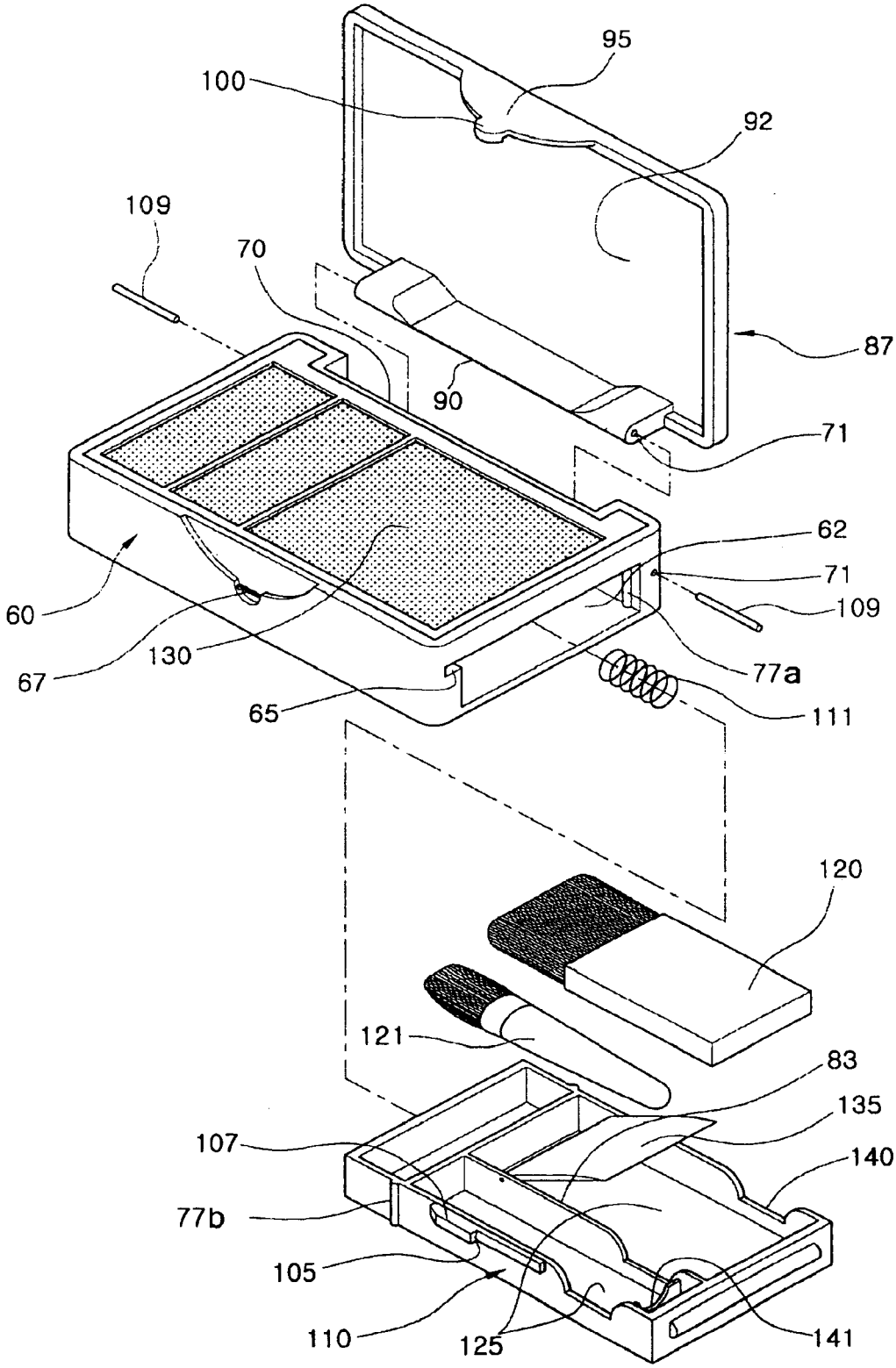
FIG. 4 is an exploded perspective view of a cosmetic case according to a second preferred embodiment of the present invention.

As shown in FIG. 4, the main case 60 is made of an integrated plate surrounding all direction and constructed in such that the lower portion is closed and the upper portion is opened. The main case 60 includes an opening path 62 formed in one side thereof, a horizontally straight slot 65 formed in the front surface of the inside thereof, a locking groove 67 formed in the front surface of the main case 60 and connected with the straight slot 65, a coupling groove 70 formed in the center of the rear surface of the inside of the main case 60 and recessed inwardly, shaft holes 71 formed in both sides of the side portion, a seating step 75 formed on the top surface of the plate surrounding all directions of the main case 60, and protrusions 77 formed on both side surfaces of the opening path 62.

Figure 5:
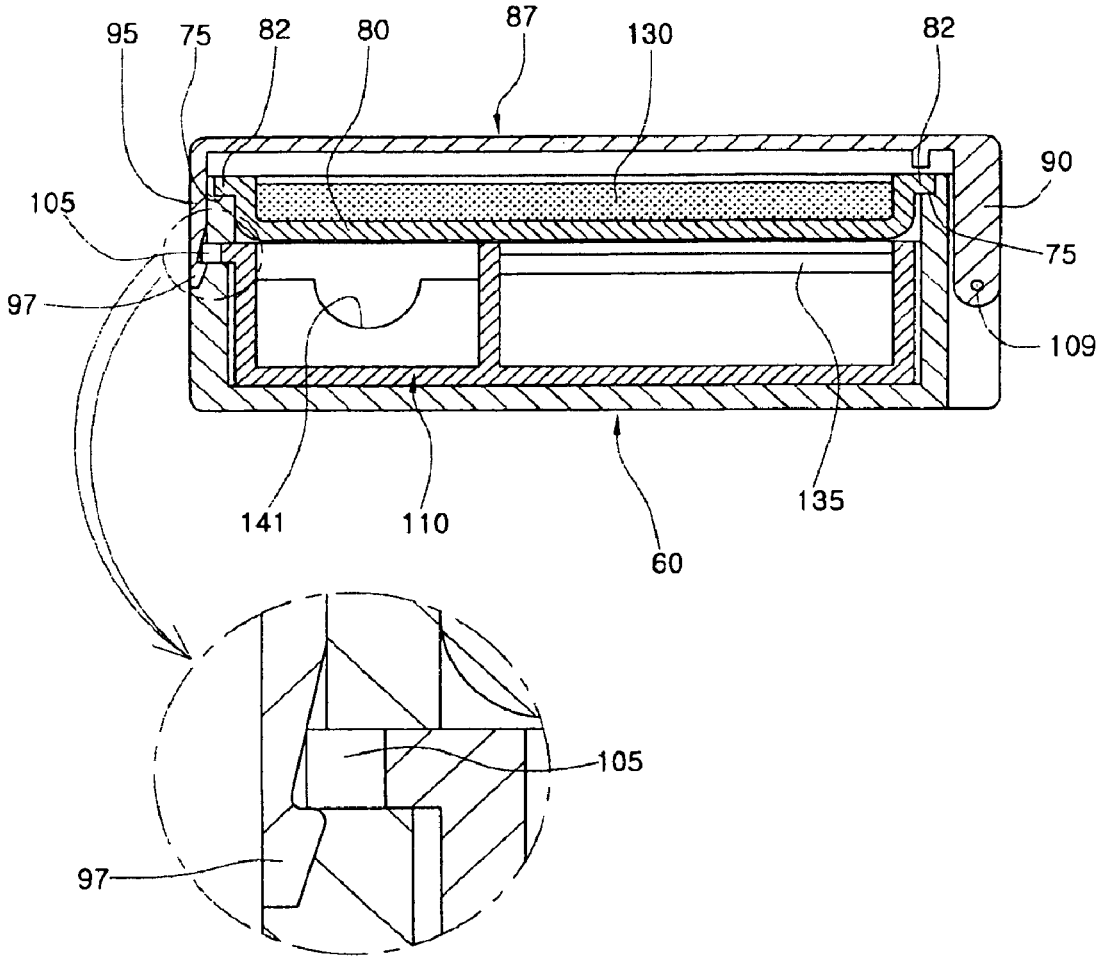
FIG. 5 is a sectional view of the cosmetic case according to the second preferred embodiment.
Figure 6:
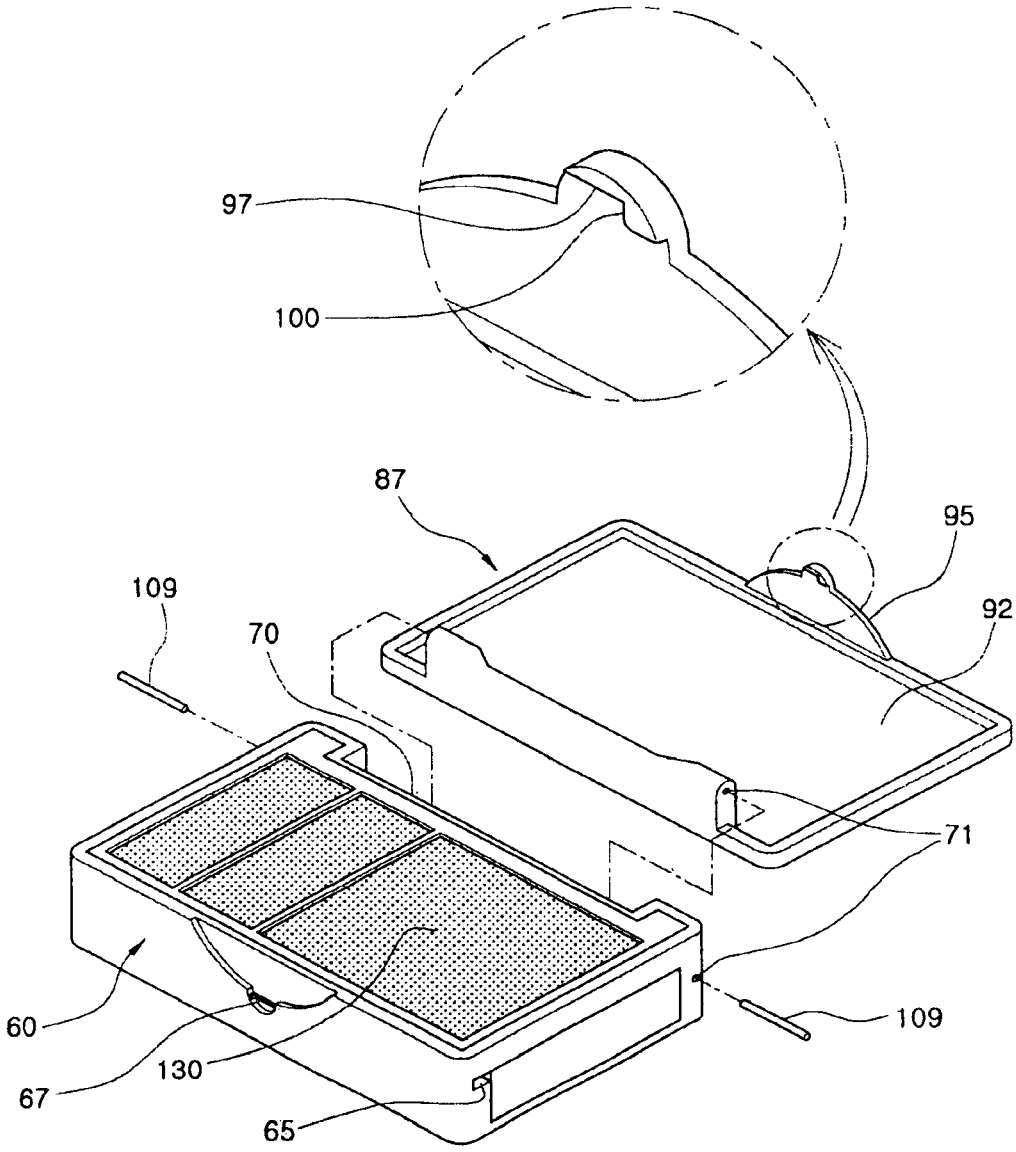
FIG. 6 is an exploded perspective view, in enlargement, of a locking panel according to the second preferred embodiment of the present invention.

As shown in FIG. 5, the make-up case 80 includes a flange 82 matching with the shape of the seating step 75 of the main case 60, and a partition 83 formed integrally with the flange 82 for containing cosmetics 130 of various kinds. The partition 83 can be formed in various shapes, such as a lattice, a circle or others, for receiving the cosmetics 130 of various kinds.

The cover 87 includes a coupling plate 90 matching with the coupling groove 70 of the main case 60 and having shaft holes 71 hinged with the shaft holes 71 of the main case 60 and a concave portion formed on the center and having inclined surface on both sides, a cover plate 92 being at a right angle to the coupling plate 90 and having the protruding circumference, and a locking panel 95 having a locking jaw 97 coupled with the locking groove 67 of the main case 60 and a locking step 100 being at a right angle to the locking jaw 97.

The receiving drawer 110 of a rectangular drawer type includes the partition 83 for making a receiving space 125 to receive make-up tools, a stop step 105 inserted and sliding into the straight slot 65 of the main case 60 and locked to the locking step 100 of the locking panel 95, a slider 107 mounted on the outer side surface and having the lower surface caught to the locking jaw 97, and protrusions 77 formed on both sides. The receiving drawer 110 has a receiving cover 135 hinged to the partition 83 and the top portion of the side plate for partially opening closing the receiving space 125.

Furthermore, the partition 83 and the side plate for forming the receiving space 125 of the receiving drawer 110 respectively have pickup grooves 140 for allowing a user to easily pick up the make-up tools. The receiving space 125 has a semicircle groove 141 for seating a round article, such as a grip of a toilet brush 120.

A hinge shaft 109 is inserted into the shaft holes 71 of the main case 60 and the shaft holes 71 formed in both sides of the coupling plate 90 of the cover 87 so as to hinge the cover 87 to the main case 60.

A coil spring 111 is mounted inside the main case 60 to provide elasticity to the receiving drawer 110 under condition in which the side surface of the receiving drawer 110 is in contact with the inner surface of the main case 60, so that the receiving drawer 110 is bounced out of the main case 60.

In both embodiments of the present invention, it is preferable to mount a mirror on the cover 20 or 87 for opening the upper portion of the main case 1 or 60.

A function according to the first preferred embodiment of the present invention will be described as follows. When the cover 20 is rotated and opened to separate the locking panel 23 of the cover 20 from the locking groove 38 of the receiving drawer 30, the receiving drawer 30 is rotated inside the main case 1 and exposed to the outside by the spring 40. At this time, the user can paint the cosmetics contained in the receiving space 3 of the main case 1 to wanted portions of the user's face using a brush 50 loaded on the receiving drawer 30.

A function according to the second preferred embodiment of the present invention is similar to that of the first preferred embodiment. When the cover 87 is rotated so as to separate the locking jaw of the locking panel 95 from the lower surface of the stop step 105 of the slider 107 protruding to the locking groove 67 of the main case 60, the locking between the locking step 100 of the locking panel 95 and the stop step 105 is removed, and then, the receiving drawer 110 restricted in lateral movement along the opening path 62 is exposed out of the opening path 62 by elasticity of the coil spring 111. As in the first embodiment, the user can paint the cosmetics 130 contained in the make-up case 80 or the receiving drawer 110 to wanted portions of the user's face using a brush 120 loaded on the receiving drawer 110. In the first and second preferred embodiments, when the receiving drawer 110 is pushed into the main case 60 and the cover 87 is closed, the receiving drawer 110 is placed under restraint inside the main case 60.

According to the present invention, the cosmetic case has a compact receiving space by forming the double cosmetic receiving space, is easy in use and carrying as it exposes the receiving drawer when the user opens the cosmetic case.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A cosmetic case comprising:

a main case having a cosmetic receiving space comprising a round plate for storing foundation, a chamber located on the lower portion of the receiving space and having a plate surrounding all directions of the receiving space and an upper plate and a lower plate, an opening path formed in a side of the chamber, a protrusion formed on the rear portion of the main case and having a shaft hole for hinge coupling, and a guide groove formed in the front surface of the main case;

a cover having a lid for receiving the round plate of the main case, coupling plates coupled to the cover, each of the coupling plate having a shaft hole to be hinged to the protrusion of the main case, and a locking panel having a locking jaw corresponding to the guide groove;

a receiving drawer having a pin for hinging the upper plate and the lower plate of the chamber of the main case, and a locking groove matching with the locking panel and having a locking protrusion for fixing the locking jaw; and a spring having an end fixed to the main case, the other end fixed to a hole formed in the receiving drawer, and a coiled portion for inserting a pin of the receiving drawer.

2. A cosmetic case comprising:

a main portion comprising an integrated plate surrounding and so constructed and arranged that when the lower portion is closed the upper portion is opened, the main case having an opening path formed in one side thereof, a horizontally straight slot formed in the front surface of the inside thereof, a locking groove formed in the front surface of the main case and connected with a straight slot, a coupling groove formed in the center of the rear surface of the inside of the main case and recessed inwardly, shaft holes formed in both sides of the side portion, a seating step formed on the top surface of the plate surrounding the main portion, and protrusions formed on both side surfaces of the opening path;

a make-up case having a flange conforming to the shape of the seating step of the main case, and a partition formed integrally with the flange for allowing receipt of different cosmetics;

a cover having a coupling plate matching with the coupling groove of the main case, a cover plate located at a right angle to the coupling plate and having a protruding circumference, and a locking panel having a locking jaw coupled with the locking groove of the main case and a locking step located at a right angle to the locking jaw, the coupling plate having shaft holes corresponding and hinged with the shaft holes of the main portion, a concave portion formed on the center and having an inclined surface on both sides;

a receiving drawer of a rectangular drawer type, the receiving drawer having a partition for making a receiving space to receive make-up tools, a stop step inserted and sliding into the straight slot of the main case and locked to the locking step of the locking panel a slider mounted on the outer side surface and having the lower surface caught to the locking jaw, and protrusions formed on both sides;

a hinge shaft inserted into the shaft hole formed in the side surface of the main case and the shaft hole formed in the both sides of the coupling plate of the cover for hinging the cover to the main portion; and a coil spring mounted on the main portion for providing elasticity so that the receiving drawer is bounced out of the main portion.

3. The cosmetic case according to claim 2, wherein the receiving drawer includes the partition and a receiving cover hinged to the top of the side plate for opening and closing a part of the receiving space.

4. The cosmetic case according to claim 2, wherein the partition and the side plate constituting the receiving space respectively have a pickup groove for allowing a user to easily pick up toilet tools, and the receiving space has a semicircle groove for seating a round article, such as a grip of a make-up brush.

5. The cosmetic case according to claim 2, wherein the cover has a mirror.

6. The cosmetic case according to claim 1, wherein the cover has a mirror.

* * * * *